US011825927B2

(12) United States Patent
Salciarini

(10) Patent No.: US 11,825,927 B2
(45) Date of Patent: Nov. 28, 2023

(54) POT FOR COSMETIC PRODUCT

(71) Applicant: CHANEL PARFUMS BEAUTE, Neuilly-sur-Seine (FR)

(72) Inventor: Christian Salciarini, Hyeres (FR)

(73) Assignee: CHANEL PARFUMS BEAUTE, Neuilly-sur-Seine (FR)

( * ) Notice: Subject to any disclaimer, the term of this patent is extended or adjusted under 35 U.S.C. 154(b) by 23 days.

(21) Appl. No.: 16/620,424

(22) PCT Filed: Jun. 4, 2018

(86) PCT No.: PCT/EP2018/064611
§ 371 (c)(1),
(2) Date: Dec. 6, 2019

(87) PCT Pub. No.: WO2018/224434
PCT Pub. Date: Dec. 13, 2018

(65) Prior Publication Data

US 2020/0085166 A1 Mar. 19, 2020

(30) Foreign Application Priority Data

Jun. 7, 2017 (FR) ..... 1755052

(51) Int. Cl.
*A45D 40/00* (2006.01)
*B65D 43/02* (2006.01)
*B65D 53/04* (2006.01)

(52) U.S. Cl.
CPC ..... *A45D 40/0068* (2013.01); *B65D 43/0212* (2013.01); *B65D 53/04* (2013.01);
(Continued)

(58) Field of Classification Search
CPC . A45D 40/0068; B65D 43/0212; B65D 53/04
(Continued)

(56) References Cited

U.S. PATENT DOCUMENTS 3,910,444 A * 10/1975 Foster ..... B65D 43/021 215/295
5,209,362 A * 5/1993 Lutzker ..... B65D 51/145 215/225

(Continued)

FOREIGN PATENT DOCUMENTS

EP 2 371 729 A1 10/2011
FR 2 701 366 A1 8/1994

(Continued)

*Primary Examiner* — Jeffrey R Allen
(74) *Attorney, Agent, or Firm* — GREENBLUM & BERNSTEIN. P.L.C.

(57) ABSTRACT

A pot for a cosmetic product including a base topped by a substantially cylindrical neck defining an opening, and a lid equipped with a seal having top and bottom surfaces. The neck of the pot has a rim with an inner periphery having a shoulder forming a concave surface. The bottom surface of the seal includes a flexible annular lip that has a convex shape on an outer peripheral wall which, when the lid is tightened on the base, matches the concave surface over at least a portion of the height of the shoulder and presses sealingly against the rim around the entire inner periphery of same to sealingly close the pot. The flexibility of the seal and the shape of the lip thereof, which complements that of the rim, allow it to be deformed to be able to compensate for dimensional irregularities during at manufacture ensuring tight sealing.

15 Claims, 5 Drawing Sheets

(52) U.S. Cl.
CPC ..... *A45D 2200/051* (2013.01); *B65D 2543/00203* (2013.01); *B65D 2543/00231* (2013.01); *B65D 2543/00527* (2013.01); *B65D 2543/00537* (2013.01); *B65D 2543/00629* (2013.01); *B65D 2543/00703* (2013.01)

(58) Field of Classification Search
USPC ..... 215/214, 225, 224
See application file for complete search history.

(56) References Cited

U.S. PATENT DOCUMENTS

| | | | | |
|---|---|---|---|---|
| 5,862,928 | A * | 1/1999 | Breuer | B65D 53/04 215/350 |
| 6,102,225 | A * | 8/2000 | Lynn | B65D 39/08 215/252 |
| 2017/0107027 | A1 | 4/2017 | Sangiovanni | |
| 2018/0132592 | A1 * | 5/2018 | Chung | A45D 40/22 |

FOREIGN PATENT DOCUMENTS

| | | | |
|---|---|---|---|
| FR | 2 776 625 | A1 | 10/1999 |
| FR | 3 032 335 | A1 | 8/2016 |
| WO | WO 2015/181726 | A1 | 12/2015 |

* cited by examiner

POT FOR COSMETIC PRODUCT

BACKGROUND

1. Field of the Invention

The present invention concerns the field of pots, in particular that of pots for cosmetic products. By cosmetic product is meant in particular all make-up products for the skin and all compositions provided for application to the body.

2. Description of Background

Cosmetic product pots generally comprise a base configured, to contain a cosmetic product, surmounted by a neck having a diameter of opening close to that of the cross-section of the base. The base is closed by a lid, for example screwed onto the neck. In order to seal the closure, a seal is generally interposed between the lid and the base.

Various configurations are known in the state of the art to obtain a sufficient level of sealing. According to a first known configuration, fastening members may be present on the lower face of the lid as well as on the upper face of the seal in order to enable the seal to espouse the lower face of the lid. These fixing members may for example be projections which come to be screwed onto each other. The seal is then compressed against the neck at the time of the screwing or tightening of the lid onto the base. This type of solution is in particular proposed in document FR2776625.

Another known configuration consists of a pot comprising an annular crown surrounding the opening and the neck of the base and on which is hinged the lid. A seal, comprising a sealing lip, may then be disposed between the crown and the lid. This type of solution is in particular proposed in document FR2701366.

Cosmetic product pots implementing the aforesaid solutions are most often made from plastic material. Considerations that are for example aesthetic, environmental or functional may lead another material to be employed, for example such as glass. However, certain materials such as glass and porcelain (or another ceramic) are, during their manufacture, subject to high dimensional variations from one specimen to the next. Thus, on manufacture of a glass or ceramic pot, significant dispersion concerning the diameter or the height of the neck may occur. More particularly, the variation in dimension may be up to three times greater for glass pots than for those of plastic.

Thus, a closure system equipped with a seal as known in the prior art is unable to provide closing or opening that is easy to perform as well as satisfactory sealing for a pot of glass or of another material giving rise to dimensional dispersions from manufacture. Furthermore, given this dimensional dispersion, the force to apply on the seal (generally disposed between the lid and the base of the pot) at the time of the first use to shape it to the base of the glass pot is greater than for the plastic pot. Moreover, this force leads to higher mechanical stresses on the tightening or screwing system, which leads to greater wear of the pot over time. Lastly, the user then has to apply an increasing tightening torque, as degradation of the system progresses and the seal becomes slack.

A solution making it possible to solve the aforementioned problems linked to dimensional dispersions from manufacture of pots is thus desirable.

The invention is thus directed to providing a pot for cosmetic products enabling easy opening and closing, while ensuring a sufficient level of sealing that is obtained reliably despite dimensional dispersions on manufacture of the pots.

SUMMARY

Thus, the invention relates to a cosmetic product pot comprising a base surmounted by a substantially cylindrical neck defining an opening and a lid equipped with a seal having an upper surface and a lower surface. Said neck of the pot possesses a brim having an inside periphery comprising a shoulder which forms a concave surface. On its lower surface said seal comprises an annular flexible lip having on an outside peripheral wall a convex form which, when the lid is tightened onto the base, espouses said concave surface over at least a portion of the height of the shoulder and presses sealingly against said brim over its entire inside periphery so as to ensure fluid-tight closure of the pot.

The cosmetic product pot thus developed makes it possible to ensure good sealing as well as great ease of opening or closing of the lid on the base of the pot. Thus, the flexibility of the seal as well as the shape of its lip, which is complementary to that of the brim, enable it to deform so as to be able to compensate for the dimensional dispersions from manufacture. They also make it possible to have a low tightening torque, which reduces the risk of degradation of the pot over time.

According to some embodiments, the base of the pot may be made from glass or ceramic.

The opening may have a diameter greater than or equal to 25 millimeters.

The lid may have a system for tightening onto the base by snap engagement.

The lid may comprise a coupling plate and a cap, the coupling plate comprising claws, at least one slide and a guide stud having at least two positions, i.e. an opening position when the pot is open and a resting position when the pot is closed, the coupling plate and the cap being assembled rotatably relative to each other.

The lid may be of a type configured to close on the base by application of a vertical pressure.

The neck may comprise on its outside periphery an indentation or groove defined under a peripheral rim and in which are provided two guide ramps enabling the closing or opening of the lid on the base to be guided.

The seal may have the general shape of a disk comprising an upper face attached to the lower face of the lid.

The seal may in particular have the general shape of a disk comprising the flexible annular lip on its lower face.

The lip may be configured so as to shape itself to the concave shoulder of the brim over at least a portion of the height of said shoulder.

The seal may be made from elastic material. In this case, the seal may be made from polypropylene, polyethylene, from elastomer or from styrene-ethylene-butylene-styrene (SEBS).

In such a pot, one dimension of the lip corresponding to the length of the arc formed, in cross-section, by its outside peripheral wall, is substantially the same as the developed length of the concavity of the shoulder on the brim.

The pot may comprise a tub inside the base configured to receive the cosmetic product.

BRIEF DESCRIPTION OF THE DRAWINGS

Still other particularities and advantages of the invention will appear in the following description.

In the accompanying drawings, given by way of non-limiting example.

DETAILED DESCRIPTION

Figure 1:
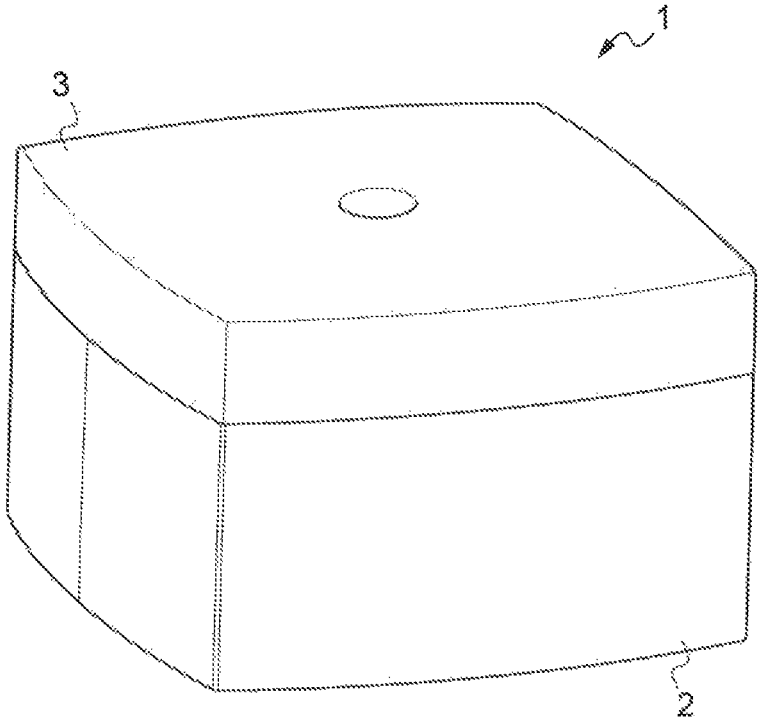
FIG. 1 shows an example embodiment of a cosmetic product pot in accordance with an embodiment of the invention.

FIG. 1 shows an example embodiment of a cosmetic product pot 1 with a square contour comprising a base 2 and a lid 3. By "square contour" is meant a pot having a base having a substantially parallelepiped shape with a square bottom, which does not exclude pots having bulging contours or any other slight alteration to its general shape. Furthermore, the present description is made for a pot 1 with a square contour, but is valid mutatis mutandis for any pot whatever the outside general shape of its base.

The base 2 may be formed from any appropriate material, but the invention is particularly advantageous for cosmetic product pots comprising a base 2 of glass, of porcelain or of similar material such as certain ceramics that may present a problem of dimensional dispersion as explained above.

Figure 2:
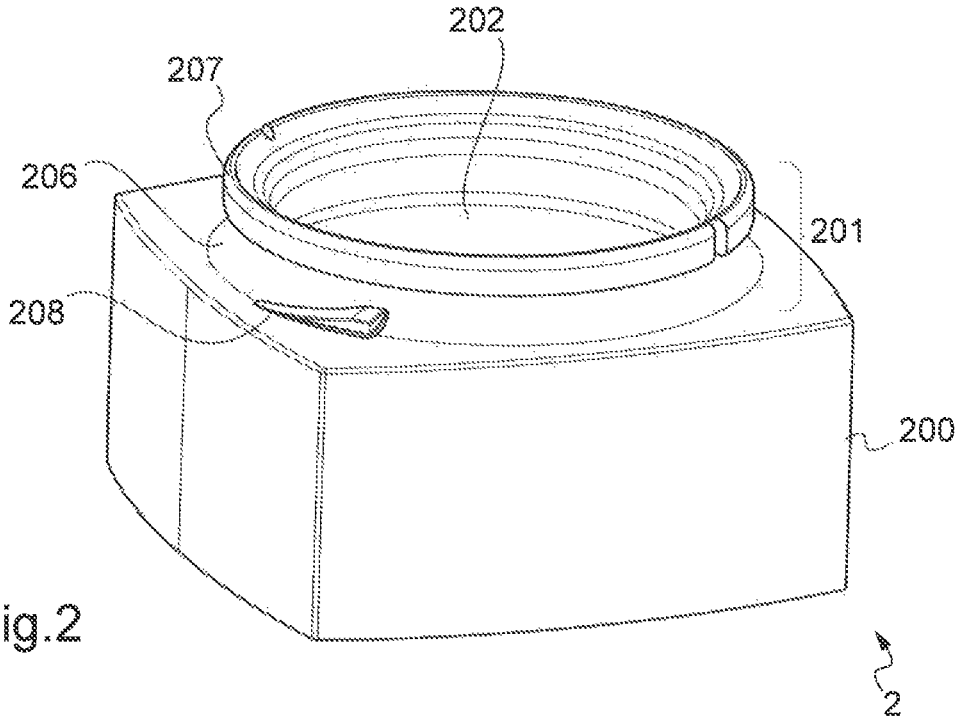
FIG. 2 shows the base of the pot of FIG. 1 comprising a neck of cylindrical shape which comprises a brim having an inside periphery comprising a shoulder.

As is visible in FIG. 2, the base 2 comprises a container 200 and a neck 201 which surmounts the container 200.

The neck 201 of cylindrical shape defines an opening 202 which enables access to a product contained in the container 200. In the example represented here, the dimensions of the neck 201 and of the opening 202 are close to the cross-sectional dimensions of the base 2. The opening 202 of the pot 1 is sufficiently wide to enable the passage of at least one finger of a hand, that is to say that it has for example a diameter greater than or equal to 25 millimeters.

On its outside periphery the neck 201 has an indentation or groove 206, and a peripheral rim 207 under which is defined the indentation or groove 206. These latter extend all around the neck 201.

Figure 6:
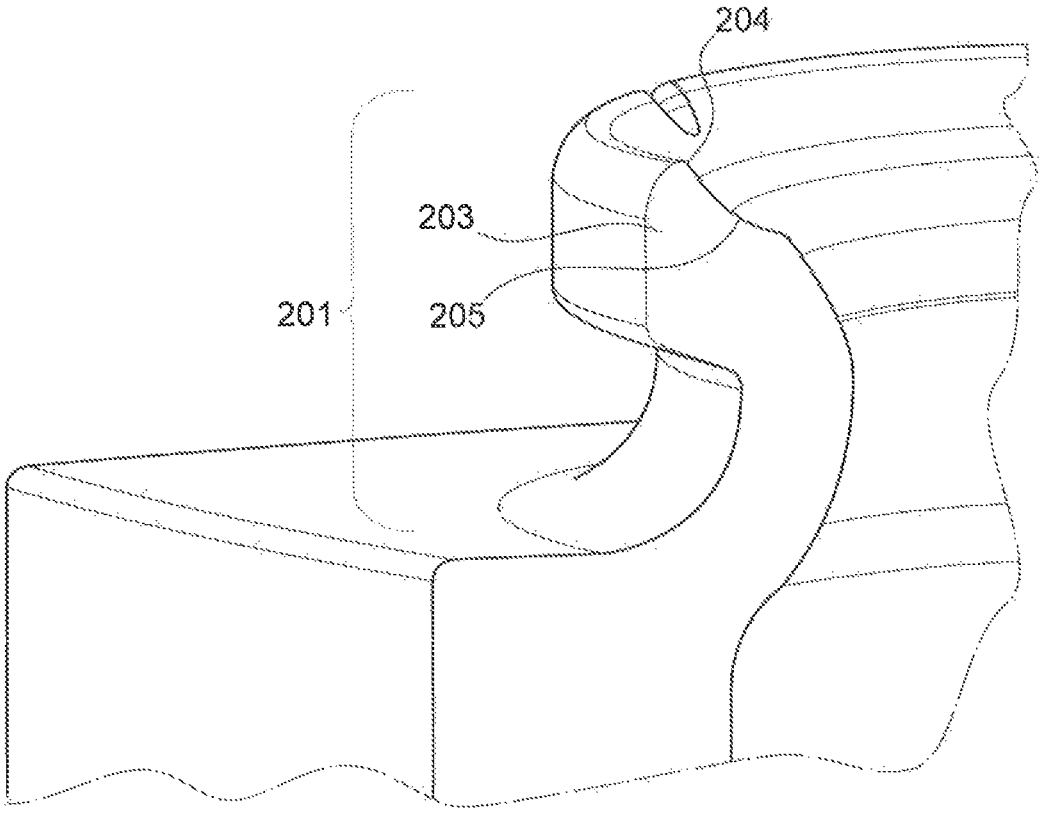
FIG. 6 shows an partial view of the brim of the pot of FIG. 1.

The neck 201 also comprises a brim 203 on the inside periphery of which is formed a shoulder 204 enabling a concave surface to be created. By brim 203 is meant the part of the neck 201 located above the indentation or the groove 206. A partial view of the brim 203 of the pot 1 is presented in FIG. 6.

According to the embodiment illustrated in FIG. 2, two guide ramps 208, diametrically opposite each other, create a projection in the indentation or groove 206. They comprise a sloped part at the end of which is an unsloped part. These guide ramps 208 serve as guides when the lid 3 is screwed onto the pot 1.

The opening or the closing of the pot 1 is made by virtue of the lid 3. On opening the pot 1, the user turns the lid 3, for example anticlockwise. By virtue of their sloped part, the guide ramps 208 enable easy opening of the pot 1. On closing the pot 1, the user turns the lid 3, for example clockwise. The unsloped parts of the guide ramps 208 then block the screwing operation, indicating to the user that the closing position of the pot 1 has been attained. The opening or the closing of the pot 1 is thus not carried out by full screwing but only by slightly turning the lid 3. The angle of screwing or unscrewing of the lid 3 may be defined by the dimensions of the guide ramps 208. The guide ramps 208 cooperate with the lid 3 and enable it to be indicated to the user that the pot 1 is in opening position or closing position.

Figure 3:
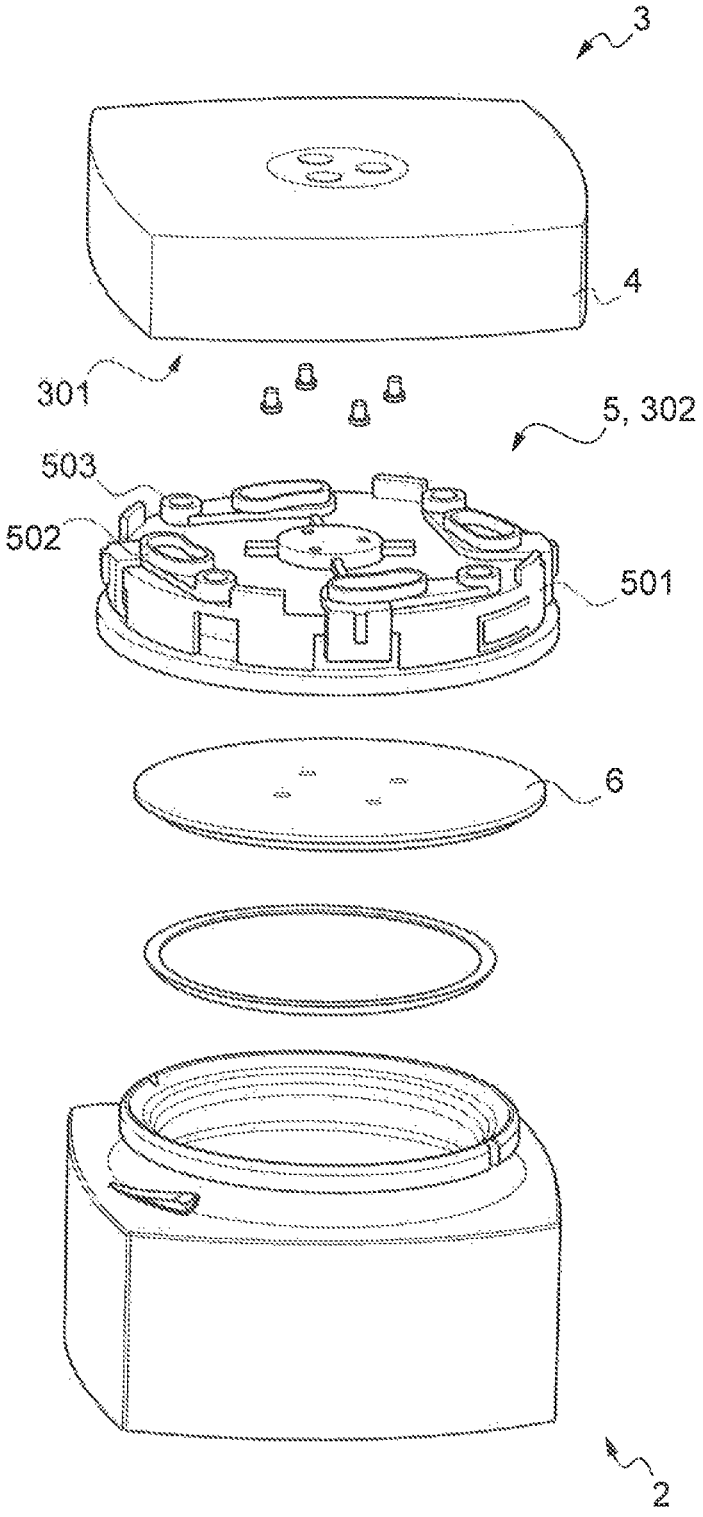
FIG. 3 shows an exploded view of the pot of FIG. 1.

As illustrated in FIG. 3, the lid 3 comprises a lower face 301 comprising a closure system 302 and an outside part, called cap 4. This closure system 302 may be a screwing system or a tightening system of the neck 201. This tightening may be achieved by snap engagement, by coupling members or by any other equivalent system.

FIG. 3 shows an exploded view of the pot 1 of FIG. 1 comprising a lid 3 having a closure system 302 produced by coupling members which can be employed in a pot according to the invention. The lid 3 comprises an inside part called coupling plate 5 rotationally mounted relative to the cap 4.

Generally, for this type of closure system, coupling plate 5 comprises claws 501 having at least two positions: a first opening position referred to as opening position of the lid 3 and a second position referred to as resting position when the pot is closed by the lid 3. When the lid 3 is in resting position and the pot 1 is closed, the claws 501 are engaged in the indentation or groove 206 of the neck 201 of the base 2. When the lid 3 is in opening position, the claws 501 are away from the neck 201 relative to the first position and are disengaged from the indentation or groove 206.

According to the embodiment presented in FIG. 3, the lid 3 also comprises three slides 502 and three guide studs 503 configured to slide relative to the slides 502 between said first position and said second position. The coupling plate 5 takes said first position when the guide studs 503 are in the first position relative to the slides 502 and the coupling plate 5 takes the second position when the guide studs 503 are in the second position relative to the slides 502.

The cap 4 and the coupling plate 5 thus cooperate to enable easy opening and reliable closing of the pot 1. The lid 3, as presented in FIG. 3, is described in more detail in the FR3032335 document.

In order to ensure the sealing of the pot 1, a seal 6 is interposed between the base 2 and the lid 3.

Figure 4:
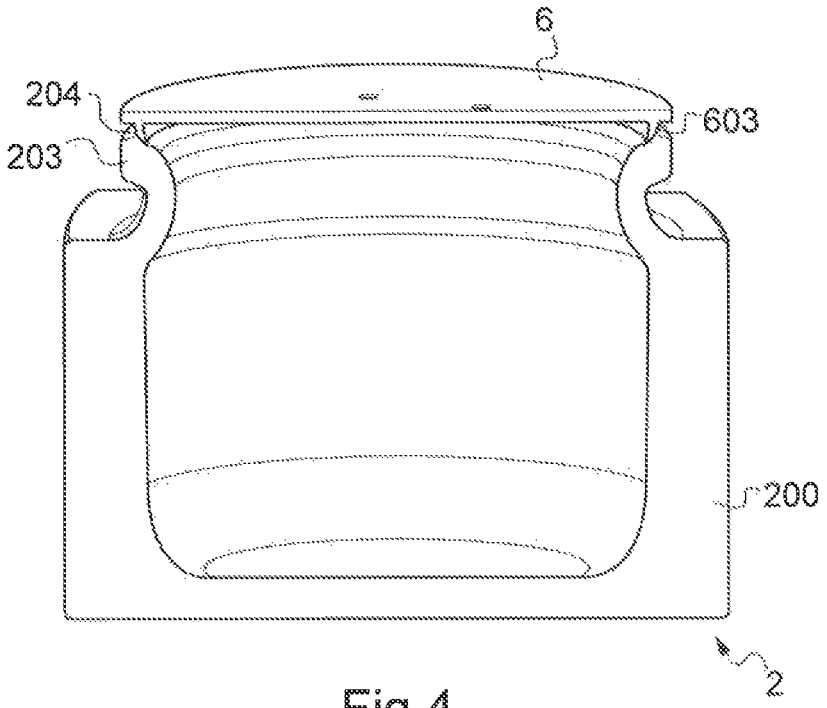
FIG. 4 shows a cross-section of the base of the pot of FIG. 1 on which a seal comes to bear.

FIG. 4 shows the interaction between the lip 603 and the brim 203. This interaction will be described in more detail below.

Figure 5A:
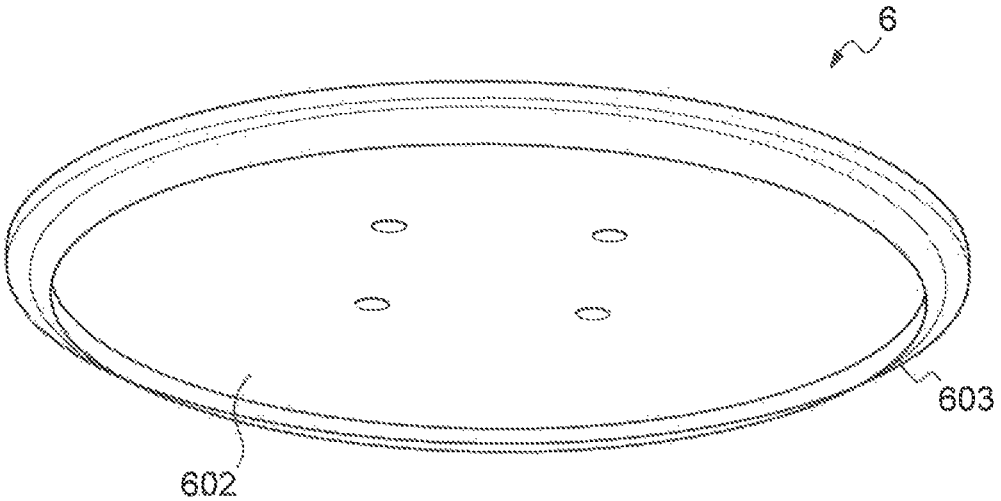
FIG. 5*a* shows a seal which may be employed in the invention.
Figure 5B:
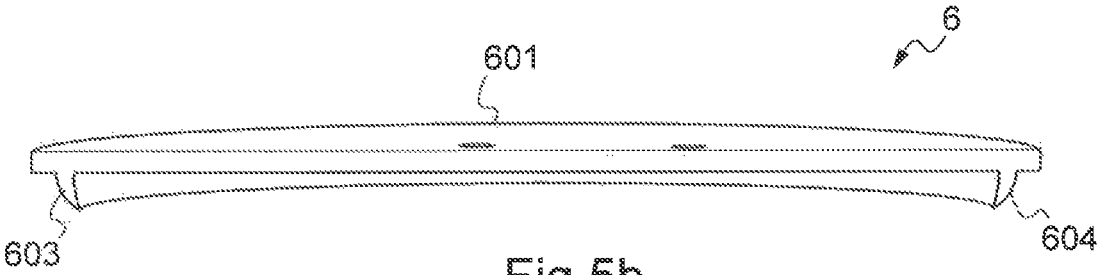
FIG. 5*b* shows a cross-section view of the seal of FIG. 5*a;*

As presented in FIGS. 5*a* and 5*b*, the seal 6 is a disk which has an upper surface 601, oriented towards the lid 3, and a lower surface 602, oriented towards the container 200.

The upper surface 601 is attached to the lower face 301 of the lid 3. The upper surface 601 may for example be bonded to the lower surface 301 of the lid 3. However, the seal 6 may be attached to the lid 3 by any other appropriate known means.

As regards the lower surface 602, a flexible lip 603 extends downwardly therefrom, as shown in FIG. 5*b*. The lip 603 has a convex form on its outside peripheral wall 604. The latter enables fluid-tight sealing of the pot 1.

More particularly, when the lid 3 is tightened onto the base 2, the convex form of the lip 603 comes to espouse the concave surface 205 of the shoulder 204 over at least a portion of its height and presses sealingly against the brim 203 over the whole of its inside periphery.

The tightening of the lid 3 onto the base 2 is made for example by holding in bearing relationship on the neck 201 or by application of a vertically pressing bearing force of the lid 3 on the base 2.

On tightening of the lid 3 onto the base 2, the lip 603 slides in order to pass from the resting state to the bearing state thereby enabling the outside wall 604 that has a convex shape to press against the brim 203.

Figure 7:
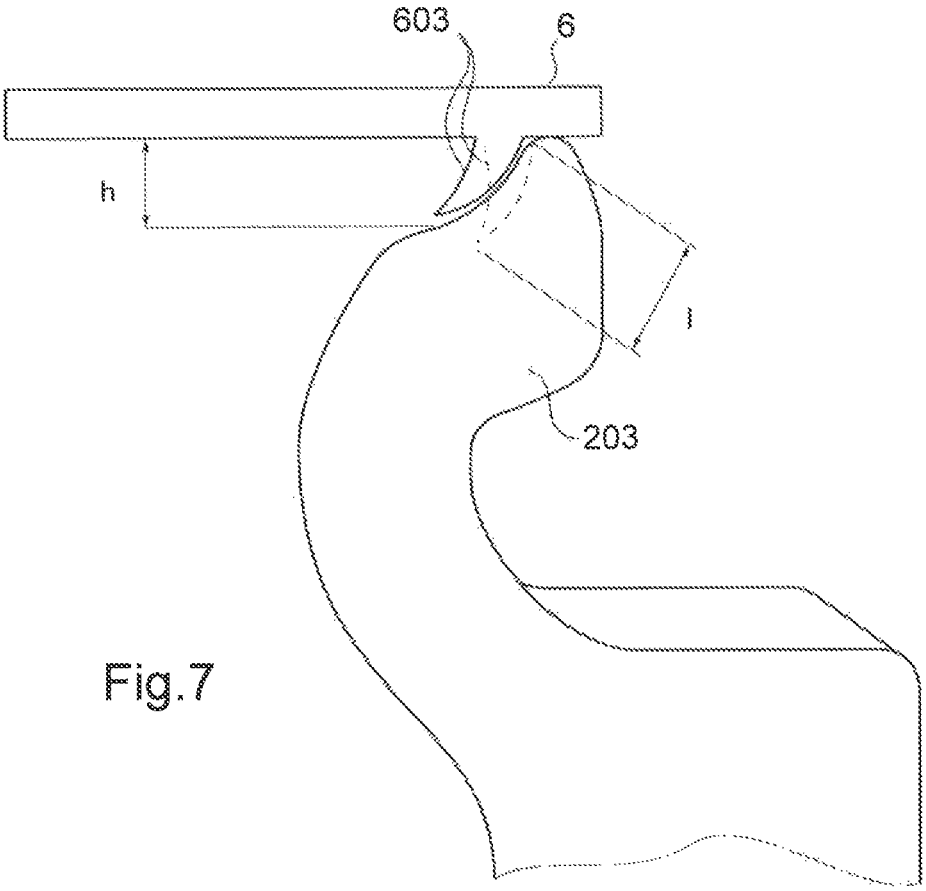
FIG. 7 shows a cross-section at larger scale of the lip in the resting position as well as when it is pressed against the brim on tightening the lid onto the base.

FIG. 7 presents a cross-section at a larger scale of the lip 603 in the resting state (shown in dashed line) as well as when it is pressed against the brim 203 (represented in full line) on closing the lid 3 onto the base 2.

When the lid 3 is in resting position, the seal 6 is compressed and the lip 603 is pressed against the brim 203. FIG. 7 shows fitting together of shape between the lip 603 and the brim 203 on closing the pot 1. When the lid 3 is in opening position, the lip 603 is relaxed. Through elastic return, the lip 603 then adopts the configuration represented in dashed line.

As FIG. 7 shows, the brim 203 has a height h and the lip 603 has a dimension l corresponding to the length of the arc formed, in cross-section, by its outside peripheral wall 604. On tightening the lid 3 onto the base 2, the contact between the lip 603 and the brim 203 is obtained over at least a portion of the height h. This contact is obtained by the tightening force of the lid 3 onto the base 2, in conjunction with the tendency of the lip 603 to resume, through elasticity, the resting position illustrated in dashed line in FIG. 7.

Preferably, the dimension l of the lip 603 is substantially the same as the developed length of the concavity of the shoulder 204 on the brim 203. This makes it possible to optimize the sealing of the pot 1.

The seal 6 may be made from any appropriate elastic material, polypropylene, polyethylene, but also from an elastomer in particular styrene-ethylene-butylene-styrene (SEBS, a thermoplastic elastomer), or any other material having equivalent physical properties. The elasticity of the lip 603 of the seal 6 enables it to deform to compensate for the dimensional variations in manufacture of the pot 1 from one specimen to the next. It also enables it to resume its resting state (shown in dashed line in FIG. 7) in the absence of mechanical stress applied to it.

Moreover, in case of a reduction in pressure of the surrounding environment relative to the interior of the closed pot 1, for example in an aircraft, the reduction in pressure creates a force which presses the lip 603 of the seal 6 against the shoulder 204 of the brim 203 and further ensures sealing.

The seal 6 thus ensures good sealing in all circumstances.

Cosmetic product pots may also be subject to degradations. More particularly, cosmetic product pots are generally subjected to frequent manipulations (for closing and opening). Thus, it is desirable for the pot 1 not to degrade further to these manipulations and for its closing or opening to be easy and remain so over time.

This is why the closing of the pot 1 is preferably carried out by application of vertical pressing without rotation relative to the base 2. Furthermore, the form and the material of the seal 6 and of the lip 603 make it possible to reduce the force required to apply for closing the pot 1. As a matter of fact, there is no need to apply a high force in order to shape the seal 6 to the pot and in particular to the shoulder of its brim. The small force applied avoids the degradation of the pot 1, in particular of the lid 3 and of its closure system 302, and of the seal 6.

Thus, the seal 6 makes it possible to broadly make up for the dimensional tolerances (axial or in terms of thickness of the glass for example) while keeping the force required for the closure of the pot to a low level.

The seal 6 may have additional advantages if it is used with the closure system 302 comprising a coupling plate 5, as described above.

Thus, in the case of the use of the lid 3 of document FR3032335 in combination with a seal 6 and a base 2 as described earlier, there is little or no relative rotation between the coupling plate 5 and the neck 201. The seal 6 is not acted on, or very little acted on, in shear, and it is possible to choose a relatively adherent material which has a high coefficient of friction, which improves the sealing.

Of course, the invention is not limited to the detailed embodiment described above. Numerous variants may be envisioned without departing from the scope of the invention.

For example, the base 2 may have a cylindrical shape as is often the case for cosmetic pots.

The cosmetic product may be contained in a rechargeable tub placed inside the base 2 instead of being directly contained in the base 2 as presented in the embodiment described earlier.

The opening 202 of the pot 1 may also have other shapes, which results in correspondingly modifying the shape of the seal 6 presented in the embodiment described above as being a disk.

The seal 6 may for example have an annular general shape, or more generally have an open surface.

The invention claimed is:

1. A cosmetic product pot comprising:

a base;

a neck defining an opening surmounting the base; and a lid;

a seal interposed between the base and the lid, the seal being separate from the lid, said seal having an upper surface and a lower surface;

the neck of the pot possesses a brim having an inside periphery comprising a shoulder that forms a concave surface;

on the lower surface of the seal, the seal comprises an annular flexible lip having on an outside peripheral wall a convex form that is configured so that, when the lid is tightened onto the base, deforms by bending to espouse said concave surface over at least a portion of the height of the shoulder and presses sealingly against said brim over its entire inside periphery so as to ensure fluid-tight closure of the pot;

one dimension of the lip corresponds to a length of an arc formed in cross-section by the outside peripheral wall of the lip is the same as a developed length of the concavity of the shoulder on the brim; and the outside peripheral wall of the lip forms a convex arc extending over the entire outside peripheral wall of the lip, upward from a bottom edge of the lip to the lower surface of the seal.

2. A pot according to claim 1, wherein:

the base is made from glass or ceramic.

3. A pot according to claim 1, wherein:

the opening has a diameter greater than or equal to 25 millimeters.

4. A pot according to claim 1, wherein:

the lid has a system for tightening onto the base by snap engagement.

5. A pot according to claim 1, wherein:

the lid comprises a coupling plate and a cap, the coupling plate comprising claws, at least one slide and a guide stud having at least two positions, i.e. an opening position when the pot is open and a resting position when the pot is closed, the coupling plate and the cap being assembled rotatably relative to each other.

6. A pot according to claim 1, wherein:

the lid is configured to close on the base by application of a vertical pressure.

7. A pot according to claim 1, wherein:

the neck comprises an outside periphery having an indentation or groove defined under a peripheral rim and in which are provided two guide ramps enabling the closing or opening of the lid on the base to be guided.

8. A pot according to claim 1, wherein:

the seal has the general shape of a disk comprising an upper face attached to a lower surface of the lid.

9. A pot according to claim 1, wherein:

the seal has the general shape of a disk comprising the annular flexible lip on the lower surface of the seal.

10. A pot according to claim 1, wherein:

the lip is configured so as to shape to conform to the concave shoulder of the brim over at least a portion of the height of said shoulder.

11. A pot according to claim 1, wherein:

the seal is made from elastic material.

12. A pot according to claim 11, wherein:

the seal is made from polypropylene, polyethylene, from elastomer or from styrene-ethylene-butylene-styrene.

13. A pot according to claim 1, further comprising:

a tub inside the base configured to receive the cosmetic product.

14. A pot according to claim 1, wherein:

the neck is substantially cylindrical.

15. A pot according to claim 1, wherein:

the neck has a transverse periphery defining the opening.

* * * * *